US005666928A

United States Patent [19]

Ma

[11] Patent Number: 5,666,928

[45] Date of Patent: Sep. 16, 1997

[54] COMPRESSED GAS SUPPLY

[75] Inventor: Thomas Tsoi-Hei Ma, Essex, United Kingdom

[73] Assignee: Ford Global Technologies, Inc., Dearborn, Mich.

[21] Appl. No.: 714,073

[22] PCT Filed: Feb. 22, 1995

[86] PCT No.: PCT/GB95/00366

§ 371 Date: Nov. 13, 1996

§ 102(e) Date: Nov. 13, 1996

[87] PCT Pub. No.: WO95/24553

PCT Pub. Date: Sep. 14, 1995

[30] Foreign Application Priority Data

Mar. 9, 1994 [GB] United Kingdom ..... 9404497

[51] Int. Cl.[6] ..... F02M 23/00

[52] U.S. Cl. ..... 123/534

[58] Field of Search ..... 123/534, 531, 123/434

[56] References Cited

U.S. PATENT DOCUMENTS

| | | | |
|---|---|---|---|
| 1,788,578 | 2/1931 | Lord | 123/534 |
| 1,921,510 | 8/1933 | De Wasmundt | 123/534 |
| 2,057,164 | 10/1936 | Rockwell | 123/534 |
| 4,716,877 | 1/1988 | Duret | 123/531 |
| 4,936,279 | 6/1990 | Ragg | 123/533 |
| 5,390,647 | 2/1995 | Schecter | 123/532 |

*Primary Examiner*—Raymond A. Nelli
*Attorney, Agent, or Firm*—Jerome R. Drouillard

[57] ABSTRACT

The present invention relates to a compressed gas supply system in an internal combustion engine which may be used for example for an air-assisted or an air-driven fuel injector.

6 Claims, 1 Drawing Sheet

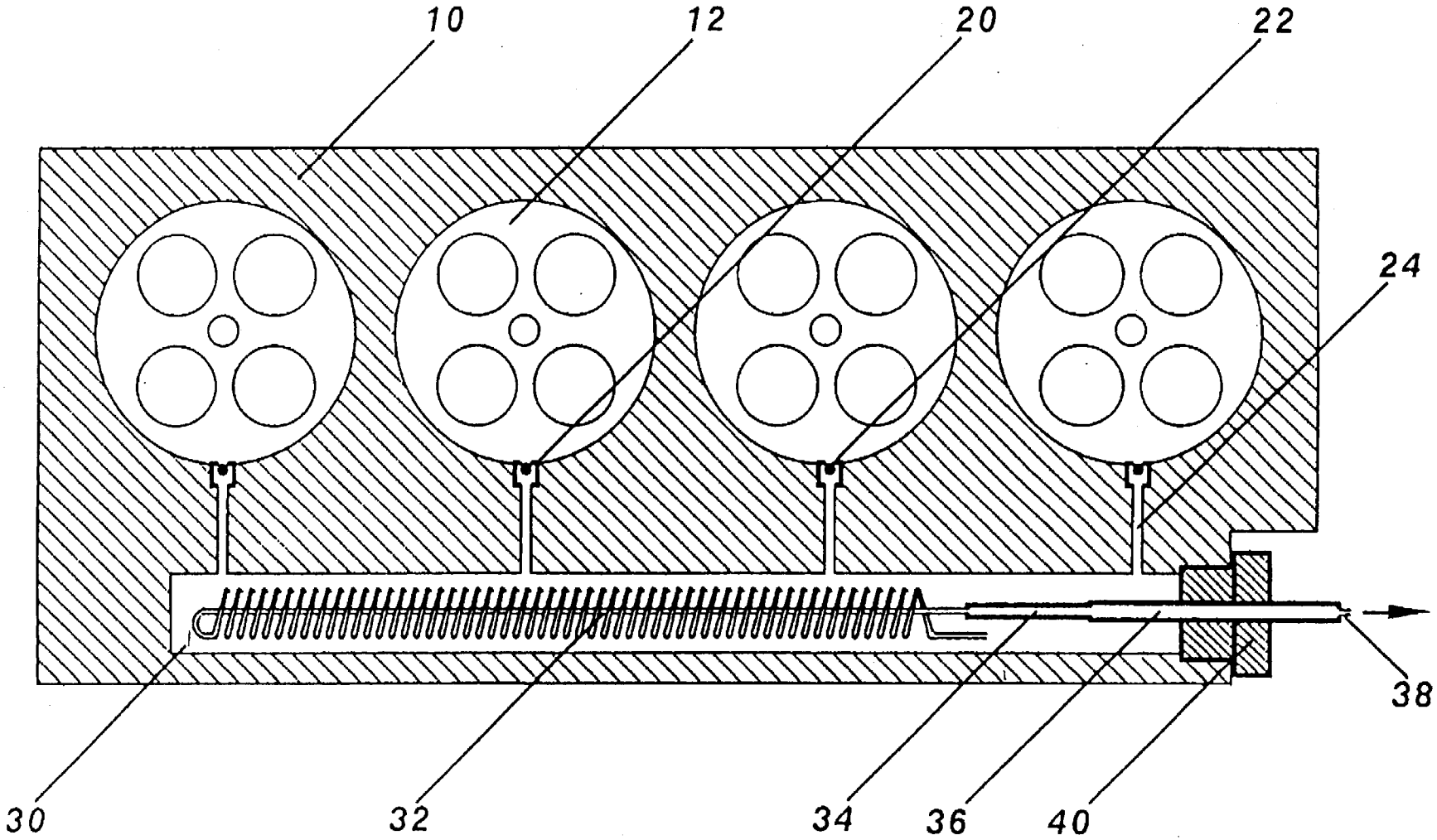
10
12
20
22
24
30
32
34
36
38
40

COMPRESSED GAS SUPPLY

BACKGROUND OF THE INVENTION

Air-assisted and air driven fuel injectors have been proposed to produce a finely atomised spray of fuel. However, such injectors require a source of compressed gas. Previously, mechanically driven compressors were used for this purpose but apart from their additional cost such compressors set a lower limit on the idling speed because the air used for atomisation bypassed the intake throttle.

To mitigate the foregoing disadvantages, a compressed gas supply in an internal combustion engine has been proposed in EP-A-315,328 that comprises a one-way valve in at least one of the combustion chambers of the engine for bleeding a small proportion of the compressed charge into a plenum chamber. The plenum chamber has an outlet from which gases can be supplied at a pressure substantially lower that the pressure within the plenum chamber.

It is desirable in such a engine to provide a regulating valve that can allow a gas flow regulation dependent on the temperature of the engine. One should draw a greater mass of gas during cold starts and warming up of the engine to improve atomisation. However, when the engine is warm, a lesser mass of gas is sufficient to achieve good mixture preparation and continuing to extract gas at the same rate as during cold operation would be wasteful of energy. The provision of a regulating valve that can vary with engine temperature in this way adds to the complexity and the cost of the regulating valve.

According to the present invention, there is provided a compressed gas supply in an internal combustion engine, comprising a one-way valve in at least one of the combustion chambers of the engine for bleeding a small proportion of the charge compressed in the combustion chamber into a plenum chamber and a tube communicating at one end with the plenum chamber and having at its other end an outlet from which gases can be supplied at a pressure substantially lower than the pressure within the plenum chamber, wherein the tube is a capillary tube that acts as a temperature dependent flow regulator.

The invention therefore is based on the use of a capillary tube to regulate the pressure drawn from the plenum chamber, which is at a pressure substantially equal to the peak pressure in the combustion chambers. Such a means of dropping the pressure from typically 13,680 KPa (2000 psi) to between 103 and 513 KPa (15 and 75 psi), has the advantage of not using any moving parts and automatically permitting higher gas flow rates when the engine is cold because the viscosity of the gases flowing through the cold capillary tube is lower.

To maintain the capillary at the same temperature as the engine, it can be heated by the water jacket of the engine but the same effect can be achieved by forming the plenum chamber within the body of the engine and housing the capillary tube within the plenum chamber.

There is always a pressure drop across a tube that depends on the diameter of the tube, its length and the viscosity of the fluid flowing through it. One can achieve the same pressure drop either by reducing the diameter or extending the length of the tube. In the present invention, a wide range of tube lengths and diameters can achieve the desired effect but other factors place limits on these dimensions. In particular, a very narrow tube could easily be blocked and it would be difficult to calibrate the tube to give identical flow for different engines, taking into account the inevitable manufacturing tolerances. A very long and relatively wide tube on the other hand is difficult to package within the engine.

To meet these conflicting requirements, it is desirable to form the capillary tube as a coil thereby permitting a long tube of sufficient diameter to be wrapped into the space available within the plenum chamber.

The tube may be of uniform diameter throughout its length but alternatively it is possible for it to be stepped to permit a gradual transition towards the end connected to the supply outlet.

BRIEF DESCRIPTION OF FIG. 1

FIG 1. is a section through an engine formed with a compressed gas supply of the invention.

In the drawing, a cylinder head 10 having four combustion chambers 12 is formed with a long gallery 30 that constitutes a plenum chamber. The gallery 30 is connected to each of the four combustion chambers by a respective small bore drilling 24 having at its end within the combustion chamber a countersunk recess for receiving a one-way valve 20. Each one-way valve comprises a ball 22 held in place by a cap that is press fitted into the countersunk recess. The cap has a small communication hole that is sealed off by the ball 22 to isolate the combustion chamber 12 from the plenum chamber 30 when the pressure in the plenum chamber is the higher. The ball 22 is however unseated by the pressure of the combustion chamber to permit gas flow through the communication hole into the plenum chamber 30 when the pressure in the combustion chamber is the higher. In this way the pressure within the plenum chamber 30 is maintained at or near the peak pressure in the combustion chambers 12 by bleeding off just enough gases to compensate for the flow taken from the plenum chamber 30.

The plenum chamber 30 is closed to the atmosphere by a nut 40 through which passes an outlet 38 of a long tube 36, the tube diameter is stepped along its length being formed by a coiled capillary 32 at its inner end and having an intermediate portion 34. Because the capillary 32 is coiled, it can be of a very substantial length and its diameter may therefore be sufficiently large to avoid the risk of it being blocked by impurities in the gases drawn from the combustion chambers.

In operation, gases are drawn from the outlet 38 and supplied to the fuel injectors of an air-assisted or an air-driven fuel injection system. The rate at which gases can be drawn will vary with the viscosity of the gases flowing through the capillary tube 32. The viscosity itself depends on the temperature of the capillary tube 32 which is substantially the same as the engine temperature because of its being housed within the body of the engine. The capillary tube 32 thus acts as an automatic temperature dependent regulator that has no moving parts.

The described construction has many advantages in terms of easy construction and assembly in the techniques used in manufacture need not differ from the manner in which oil galleries and water coolant passages are formed in a conventional engine. Additionally the regulator can be readily extracted for servicing or cleaning.

When the gases drawn from the compressed gas supply of the present invention are used in an air-assisted fuel injection system, they offer the advantage of providing an internal recirculating loop downstream of the intake throttle that does not interfere with the breathing of the engine. For this reason higher flow rates can be used without affecting the engine idling speed.

I claim:

1. A compressed gas supply in an internal combustion engine, comprising a one-way valve (20) in at least one of the combustion chambers of the engine for bleeding a small proportion of the charge compressed in the combustion chamber into a plenum chamber (30) and a tube (32) communicating at one end with the plenum chamber (30) and having at its other end an outlet (38) from which gases can be supplied at a pressure substantially lower than the pressure within the plenum chamber, characterised in that the tube is a capillary tube (32) that acts as a temperature dependent flow regulator.

2. A compressed gas supply as claimed in claim 1, wherein the plenum chamber (30) is formed within the body of the engine and the capillary tube (32) is housed within the plenum chamber (30).

3. A compressed gas supply as claimed in claim 2, wherein the capillary tube (32) is wound into a compact coil.

4. A compressed gas supply as claimed in claim 1, wherein the capillary tube (32) is stepped to permit a gradual transition towards its end at the supply outlet (38).

5. A compressed gas supply as claimed in claim 1, wherein the plenum chamber (30) is connected to each combustion chamber (12) of the engine (10) by a drilling (24) having a countersunk recess at its end within the combustion chamber into which recess a one-way valve (20) is press fitted.

6. A compressed gas supply as claimed in claim 5, wherein the one-way valve (20) comprises a ball (22) and a cap for retaining the ball within the countersunk recess, the cap having a communication hole that is sealed off by the ball when the pressure in the plenum chamber is greater than the pressure in the combustion chamber.

* * * * *